US011448026B1

(12) United States Patent
Al-Mousa et al.

(10) Patent No.: US 11,448,026 B1
(45) Date of Patent: Sep. 20, 2022

(54) CABLE HEAD FOR A WIRELINE TOOL

(71) Applicant: Saudi Arabian Oil Company, Dhahran (SA)

(72) Inventors: Ahmed Al-Mousa, Dhahran (SA); Marius Neacsu, Dhahran (SA); Omar M. Alhamid, Dammam (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 17/246,904

(22) Filed: May 3, 2021

(51) Int. Cl.

| | |
|---|---|
| ***E21B 23/14*** | (2006.01) |
| ***E21B 17/02*** | (2006.01) |
| ***E21B 19/02*** | (2006.01) |
| ***E21B 47/09*** | (2012.01) |
| ***E21B 31/12*** | (2006.01) |
| ***E21B 47/12*** | (2012.01) |
| ***E21B 47/007*** | (2012.01) |
| ***E21B 19/084*** | (2006.01) |

(52) U.S. Cl.
CPC ..... *E21B 23/14* (2013.01); *E21B 17/026* (2013.01); *E21B 19/02* (2013.01); *E21B 19/084* (2013.01); *E21B 31/125* (2013.01); *E21B 47/007* (2020.05); *E21B 47/09* (2013.01); *E21B 47/12* (2013.01)

(58) Field of Classification Search
CPC ..... E21B 23/14; E21B 47/007; E21B 47/09; E21B 47/12; E21B 17/026; E21B 19/02; E21B 19/084; E21B 31/125
See application file for complete search history.

(56) References Cited

U.S. PATENT DOCUMENTS

| | | | |
|---|---|---|---|
| 880,404 | A | 2/1908 | Sanford |
| 1,033,655 | A | 7/1912 | Baker |
| 1,258,273 | A | 3/1918 | Titus et al. |
| 1,392,650 | A | 10/1921 | Mcmillian |
| 1,491,066 | A | 4/1924 | Patrick |
| 1,580,352 | A | 4/1926 | Ercole |

(Continued)

FOREIGN PATENT DOCUMENTS

| | | |
|---|---|---|
| AU | 636642 | 5/1993 |
| AU | 2007249417 | 11/2007 |

(Continued)

OTHER PUBLICATIONS

Al-Ansari et al., "Thermal Activated Resin to Avoid Pressure Build-Up in Casing-Casing Annulus (CCA)," SA-175425-MS, Society of Petroleum Engineers (SPE), presented at the SPE Offshore Europe Conference and Exhibition, Sep. 8-11, 2015, 11 pages.

(Continued)

*Primary Examiner* — Christopher J Sebesta
(74) *Attorney, Agent, or Firm* — Fish & Richardson P.C.

(57) ABSTRACT

The present disclosure describes a cable head for a wireline tool that includes a housing that comprises an outlet opening for a wireline and an interface configured to connect the housing to the wireline tool; a spool rotatably mounted in the housing; an anchoring point configured for mechanical attachment to an end of the wireline; and a drive configured to rotate the spool and thereby wrap a portion of the wireline around the spool to and retract the wireline into the housing. A wireline tool and a method of retrieving a lost wireline tool are also described.

24 Claims, 6 Drawing Sheets

(56) References Cited

U.S. PATENT DOCUMENTS

| | | | |
|---|---|---|---|
| 1,591,264 | A | 7/1926 | Baash |
| 1,621,947 | A | 3/1927 | Moore |
| 1,638,494 | A | 8/1927 | Lewis et al. |
| 1,789,993 | A | 1/1931 | Switzer |
| 1,896,236 | A | 2/1933 | Howard |
| 1,896,482 | A | 2/1933 | Crowell |
| 1,897,297 | A | 2/1933 | Brown |
| 1,949,498 | A | 3/1934 | Frederick et al. |
| 2,047,774 | A | 7/1936 | Greene |
| 2,121,002 | A | 6/1938 | Baker |
| 2,121,051 | A | 6/1938 | Ragan et al. |
| 2,187,487 | A | 1/1940 | Burt |
| 2,189,697 | A | 2/1940 | Baker |
| 2,222,233 | A | 11/1940 | Mize |
| 2,286,075 | A | 6/1942 | Evans |
| 2,304,793 | A | 12/1942 | Bodine |
| 2,316,402 | A | 4/1943 | Canon |
| 2,327,092 | A | 8/1943 | Botkin |
| 2,377,249 | A | 5/1945 | Lawrence |
| 2,411,260 | A | 11/1946 | Glover et al. |
| 2,481,637 | A | 9/1949 | Yancey |
| 2,546,978 | A | 4/1951 | Collins et al. |
| 2,638,988 | A | 5/1953 | Williams |
| 2,663,370 | A | 12/1953 | Robert et al. |
| 2,672,199 | A | 3/1954 | McKenna |
| 2,701,019 | A | 2/1955 | Steed |
| 2,707,998 | A | 5/1955 | Baker et al. |
| 2,708,973 | A | 5/1955 | Twining |
| 2,728,599 | A | 12/1955 | Moore |
| 2,734,581 | A | 2/1956 | Bonner |
| 2,745,693 | A | 5/1956 | Mcgill |
| 2,751,010 | A | 6/1956 | Trahan |
| 2,762,438 | A | 9/1956 | Naylor |
| 2,778,428 | A | 1/1957 | Baker et al. |
| 2,806,532 | A | 9/1957 | Baker et al. |
| 2,881,838 | A | 4/1959 | Morse et al. |
| 2,887,162 | A | 5/1959 | Le Bus et al. |
| 2,912,053 | A | 11/1959 | Bruekelman |
| 2,912,273 | A | 11/1959 | Chadderdon et al. |
| 2,915,127 | A | 12/1959 | Abendroth |
| 2,935,020 | A | 5/1960 | Howard et al. |
| 2,947,362 | A | 8/1960 | Smith |
| 2,965,175 | A | 12/1960 | Ransom |
| 2,965,177 | A | 12/1960 | Le Bus et al. |
| 2,965,183 | A | 12/1960 | Le Bus et al. |
| 3,005,506 | A | 10/1961 | Le Bus et al. |
| 3,023,810 | A | 3/1962 | Anderson |
| 3,116,799 | A | 1/1964 | Lemons |
| 3,147,536 | A | 9/1964 | Lamphere |
| 3,191,677 | A | 6/1965 | Kinley |
| 3,225,828 | A | 12/1965 | Wisenbaker et al. |
| 3,308,886 | A | 3/1967 | Evans |
| 3,352,593 | A | 11/1967 | Webb |
| 3,369,603 | A | 2/1968 | Trantham |
| 3,376,934 | A | 4/1968 | William |
| 3,380,528 | A | 4/1968 | Durwood |
| 3,381,748 | A | 5/1968 | Peters et al. |
| 3,382,925 | A | 5/1968 | Jennings |
| 3,409,084 | A | 11/1968 | Lawson, Jr. et al. |
| 3,437,136 | A | 4/1969 | Young |
| 3,667,721 | A | 6/1972 | Vujasinovic |
| 3,747,674 | A | 7/1973 | Murray |
| 3,752,230 | A | 8/1973 | Bernat et al. |
| 3,897,038 | A | 7/1975 | Le Rouax |
| 3,915,426 | A | 10/1975 | Le Rouax |
| 4,030,354 | A | 6/1977 | Scott |
| 4,039,798 | A | 8/1977 | Lyhall et al. |
| 4,042,019 | A | 8/1977 | Henning |
| 4,059,155 | A | 11/1977 | Greer |
| 4,099,699 | A | 7/1978 | Allen |
| 4,190,112 | A | 2/1980 | Davis |
| 4,227,573 | A | 10/1980 | Pearce et al. |
| 4,254,983 | A | 3/1981 | Harris |
| 4,276,931 | A | 7/1981 | Murray |
| 4,285,400 | A | 8/1981 | Mullins |
| 4,289,200 | A | 9/1981 | Fisher |
| 4,296,822 | A | 10/1981 | Ormsby |
| 4,349,071 | A | 9/1982 | Fish |
| 4,391,326 | A | 7/1983 | Greenlee |
| 4,407,367 | A | 10/1983 | Kydd |
| 4,412,130 | A | 10/1983 | Winters |
| 4,413,642 | A | 11/1983 | Smith et al. |
| 4,422,948 | A | 12/1983 | Corley et al. |
| 4,467,996 | A | 8/1984 | Baugh |
| 4,478,286 | A | 10/1984 | Fineberg |
| 4,515,212 | A | 5/1985 | Krugh |
| 4,538,684 | A | 9/1985 | Sheffield |
| 4,562,888 | A | 1/1986 | Collet |
| 4,603,578 | A | 8/1986 | Stolz |
| 4,611,658 | A | 9/1986 | Salemi et al. |
| 4,616,721 | A | 10/1986 | Furse |
| 4,696,502 | A | 9/1987 | Desai |
| 4,791,992 | A | 12/1988 | Greenlee et al. |
| 4,834,184 | A | 5/1989 | Streich et al. |
| 4,836,289 | A | 6/1989 | Young |
| 4,869,321 | A | 9/1989 | Hamilton |
| 4,877,085 | A | 10/1989 | Pullig, Jr. |
| 4,898,240 | A | 2/1990 | Wittrisch |
| 4,898,245 | A | 2/1990 | Braddick |
| 4,928,762 | A | 5/1990 | Mamke |
| 4,953,617 | A | 9/1990 | Ross et al. |
| 4,997,225 | A | 3/1991 | Denis |
| 5,012,863 | A | 5/1991 | Springer |
| 5,054,833 | A | 10/1991 | Bishop et al. |
| 5,060,737 | A | 10/1991 | Mohn |
| 5,117,909 | A | 6/1992 | Wilton et al. |
| 5,129,956 | A | 7/1992 | Christopher et al. |
| 5,176,208 | A | 1/1993 | Lalande et al. |
| 5,178,219 | A | 1/1993 | Streich et al. |
| 5,197,547 | A | 3/1993 | Morgan |
| 5,203,646 | A | 4/1993 | Landsberger et al. |
| 5,295,541 | A | 3/1994 | Ng et al. |
| 5,330,000 | A | 7/1994 | Givens et al. |
| 5,343,946 | A | 9/1994 | Morrill |
| 5,348,095 | A | 9/1994 | Worrall |
| 5,358,048 | A | 10/1994 | Brooks |
| 5,392,715 | A | 2/1995 | Pelrine |
| 5,456,312 | A | 10/1995 | Lynde et al. |
| 5,507,346 | A | 4/1996 | Gano et al. |
| 5,580,114 | A | 12/1996 | Palmer |
| 5,584,342 | A | 12/1996 | Swinford |
| 5,605,366 | A | 2/1997 | Beeman |
| 5,639,135 | A | 6/1997 | Beeman |
| 5,667,015 | A | 9/1997 | Harestad et al. |
| 5,673,754 | A | 10/1997 | Taylor |
| 5,678,635 | A | 10/1997 | Dunlap et al. |
| 5,685,982 | A | 11/1997 | Foster |
| 5,698,814 | A | 12/1997 | Parsons |
| 5,775,420 | A | 7/1998 | Mitchell et al. |
| 5,806,596 | A | 9/1998 | Hardy et al. |
| 5,833,001 | A | 11/1998 | Song et al. |
| 5,842,518 | A | 12/1998 | Soybel et al. |
| 5,881,816 | A | 3/1999 | Wright |
| 5,899,796 | A | 5/1999 | Kamiyama et al. |
| 5,924,489 | A | 7/1999 | Hatcher |
| 5,931,443 | A | 8/1999 | Corte, Sr. |
| 5,944,101 | A | 8/1999 | Hearn |
| 6,070,665 | A | 6/2000 | Singleton et al. |
| 6,112,809 | A | 9/2000 | Angle |
| 6,130,615 | A | 10/2000 | Poteet |
| 6,138,764 | A | 10/2000 | Scarsdale et al. |
| 6,155,428 | A | 12/2000 | Bailey et al. |
| 6,247,542 | B1 | 6/2001 | Kruspe et al. |
| 6,276,452 | B1 | 8/2001 | Davis et al. |
| 6,371,204 | B1 | 4/2002 | Singh et al. |
| 6,378,627 | B1 | 4/2002 | Tubel et al. |
| 6,491,108 | B1 | 12/2002 | Slup et al. |
| 6,510,947 | B1 | 1/2003 | Schulte et al. |
| 6,595,289 | B2 | 7/2003 | Tumlin et al. |
| 6,637,511 | B2 | 10/2003 | Linaker |
| 6,679,330 | B1 | 1/2004 | Compton et al. |
| 6,688,386 | B2 | 2/2004 | Comelssen |
| 6,698,712 | B2 | 3/2004 | Milberger et al. |
| 6,729,392 | B2 | 5/2004 | DeBerry et al. |

(56) References Cited

U.S. PATENT DOCUMENTS 6,768,106 B2 7/2004 Gzara et al.
6,808,023 B2 10/2004 Smith et al.
6,811,032 B2 11/2004 Schulte et al.
6,854,521 B2 2/2005 Echols et al.
6,880,639 B2 4/2005 Rhodes et al.
6,899,178 B2 5/2005 Tubel
6,913,084 B2 7/2005 Boyd
7,049,272 B2 5/2006 Sinclair et al.
7,051,810 B2 5/2006 Halliburton
7,082,994 B2 8/2006 Frost, Jr. et al.
7,090,019 B2 8/2006 Barrow et al.
7,096,950 B2 8/2006 Howlett et al.
7,117,941 B1 10/2006 Gano
7,117,956 B2 10/2006 Grattan et al.
7,128,146 B2 10/2006 Baugh
7,150,328 B2 12/2006 Marketz et al.
7,174,764 B2 2/2007 Oosterling et al.
7,188,674 B2 3/2007 McGavern, III et al.
7,188,675 B2 3/2007 Reynolds
7,218,235 B1 5/2007 Rainey
7,231,975 B2 6/2007 Lavaure et al.
7,249,633 B2 7/2007 Ravensbergen et al.
7,275,591 B2 10/2007 Allen et al.
7,284,611 B2 10/2007 Reddy et al.
7,303,010 B2 12/2007 de Guzman et al.
7,363,860 B2 4/2008 Wilson
7,383,889 B2 6/2008 Ring
7,398,832 B2 7/2008 Brisco
7,405,182 B2 7/2008 Verrett
7,418,860 B2 9/2008 Austerlitz et al.
7,424,909 B2 9/2008 Roberts et al.
7,488,705 B2 2/2009 Reddy et al.
7,497,260 B2 3/2009 Telfer
7,533,731 B2 5/2009 Corre
7,591,305 B2 9/2009 Brookey et al.
7,600,572 B2 10/2009 Slup et al.
7,617,876 B2 11/2009 Patel et al.
7,621,324 B2 11/2009 Atencio
7,712,527 B2 5/2010 Roddy
7,735,564 B2 6/2010 Guerrero
7,762,323 B2 7/2010 Frazier
7,762,330 B2 7/2010 Saylor, III et al.
7,802,621 B2 9/2010 Richards et al.
7,878,240 B2 2/2011 Garcia
7,934,552 B2 5/2011 La Rovere
7,965,175 B2 6/2011 Yamano
8,002,049 B2 8/2011 Keese et al.
8,056,621 B2 11/2011 Ring et al.
8,069,916 B2 12/2011 Giroux et al.
8,157,007 B2 4/2012 Nicolas
8,201,693 B2 6/2012 Jan
8,210,251 B2 7/2012 Lynde et al.
8,376,051 B2 2/2013 McGrath et al.
8,424,611 B2 4/2013 Smith et al.
8,453,724 B2 6/2013 Zhou
8,496,055 B2 7/2013 Mootoo et al.
8,579,024 B2 11/2013 Mailand et al.
8,579,037 B2 11/2013 Jacob
8,596,463 B2 12/2013 Burkhard
8,662,182 B2 3/2014 Redlinger et al.
8,726,983 B2 5/2014 Khan
8,770,276 B1 7/2014 Nish et al.
8,899,338 B2 12/2014 Elsayed et al.
8,991,489 B2 3/2015 Redlinger et al.
9,079,222 B2 7/2015 Burnett et al.
9,109,433 B2 8/2015 DiFoggio et al.
9,133,671 B2 9/2015 Kellner
9,163,469 B2 10/2015 Broussard et al.
9,181,782 B2 11/2015 Berube et al.
9,212,532 B2 12/2015 Leuchtenberg et al.
9,234,394 B2 1/2016 Wheater et al.
9,353,589 B2 5/2016 Hekelaar
9,359,861 B2 6/2016 Burgos
9,410,066 B2 8/2016 Ghassemzadeh
9,416,617 B2 8/2016 Wiese et al.
9,441,441 B1 9/2016 Hickie
9,441,451 B2 9/2016 Jurgensmeier
9,528,354 B2 12/2016 Loiseau et al.
9,551,200 B2 1/2017 Read et al.
9,574,417 B2 2/2017 Laird et al.
9,617,829 B2 4/2017 Dale et al.
9,657,213 B2 5/2017 Murphy et al.
9,903,192 B2 2/2018 Entchev
9,976,407 B2 5/2018 Ash et al.
10,087,752 B2 10/2018 Bedonet
10,161,194 B2 12/2018 Clemens et al.
10,198,929 B2 2/2019 Snyder
10,266,698 B2 4/2019 Cano et al.
10,280,706 B1 5/2019 Sharp, III
10,301,898 B2 5/2019 Orban
10,301,989 B2 5/2019 Imada
10,544,640 B2 1/2020 Hekelaar et al.
10,584,546 B1 3/2020 Ford
10,626,698 B2 4/2020 Al-Mousa et al.
10,787,888 B2 9/2020 Andersen
10,837,254 B2 11/2020 Al-Mousa et al.
10,975,654 B1 4/2021 Neacsu et al.
10,982,504 B2 4/2021 Al-Mousa et al.
11,187,072 B2 * 11/2021 Downey ..... E21B 47/113
2002/0053428 A1 5/2002 Maples
2002/0060079 A1 5/2002 Metcalfe
2002/0195252 A1 12/2002 Maguire
2003/0047312 A1 3/2003 Bell
2003/0098064 A1 5/2003 Kohli et al.
2003/0132224 A1 7/2003 Spencer
2003/0150608 A1 8/2003 Smith
2003/0221840 A1 12/2003 Whitelaw
2004/0040707 A1 3/2004 Dusterhoft et al.
2004/0065446 A1 4/2004 Tran et al.
2004/0074819 A1 4/2004 Burnett
2004/0095248 A1 5/2004 Mandel
2004/0168796 A1 9/2004 Baugh et al.
2004/0216891 A1 11/2004 Maguire
2005/0024231 A1 2/2005 Fincher et al.
2005/0056427 A1 3/2005 Clemens et al.
2005/0087585 A1 4/2005 Copperthite et al.
2005/0167097 A1 8/2005 Sommers et al.
2005/0263282 A1 12/2005 Jeffrey et al.
2006/0082462 A1 4/2006 Crook
2006/0105896 A1 5/2006 Smith et al.
2006/0243453 A1 11/2006 McKee
2007/0114039 A1 5/2007 Hobdy et al.
2007/0137528 A1 6/2007 Le Roy-Ddelage et al.
2007/0181304 A1 8/2007 Rankin et al.
2007/0204999 A1 9/2007 Cowie et al.
2007/0256867 A1 11/2007 DeGeare et al.
2008/0007421 A1 1/2008 Liu et al.
2008/0087439 A1 4/2008 Dallas
2008/0236841 A1 10/2008 Howlett et al.
2008/0251253 A1 10/2008 Lumbye
2008/0314591 A1 12/2008 Hales et al.
2009/0194290 A1 8/2009 Parks et al.
2009/0250220 A1 10/2009 Stamoulis
2009/0308656 A1 12/2009 Chitwood
2010/0051265 A1 3/2010 Hurst
2010/0193124 A1 8/2010 Nicolas
2010/0258289 A1 10/2010 Lynde et al.
2010/0263856 A1 10/2010 Lynde et al.
2010/0270018 A1 10/2010 Howlett
2011/0036570 A1 2/2011 La Rovere et al.
2011/0056681 A1 3/2011 Khan
2011/0067869 A1 3/2011 Bour et al.
2011/0079401 A1 * 4/2011 Gambier ..... E21B 33/16 166/117.6
2011/0168411 A1 7/2011 Braddick
2011/0203794 A1 8/2011 Moffitt et al.
2011/0259609 A1 10/2011 Hessels et al.
2011/0273291 A1 11/2011 Adams
2011/0278021 A1 11/2011 Travis et al.
2012/0012335 A1 1/2012 White et al.
2012/0067447 A1 3/2012 Ryan et al.
2012/0085538 A1 4/2012 Guerrero
2012/0118571 A1 5/2012 Zhou
2012/0170406 A1 7/2012 DiFoggio et al.

(56) References Cited

U.S. PATENT DOCUMENTS

| | | | | |
|---|---|---|---|---|
| 2012/0285684 | A1 | 11/2012 | Crow et al. | |
| 2013/0062055 | A1 | 3/2013 | Tolman | |
| 2013/0134704 | A1 | 5/2013 | Klimack | |
| 2013/0213654 | A1 | 8/2013 | Dewey et al. | |
| 2013/0240207 | A1 | 9/2013 | Frazier | |
| 2013/0269097 | A1 | 10/2013 | Alammari | |
| 2013/0296199 | A1 | 11/2013 | Ghassemzadeh | |
| 2013/0299194 | A1 | 11/2013 | Bell | |
| 2014/0138091 | A1 | 5/2014 | Fuhst | |
| 2014/0158350 | A1 | 6/2014 | Castillo et al. | |
| 2014/0231068 | A1 | 8/2014 | Isaksen | |
| 2014/0251616 | A1 | 9/2014 | O'Rourke et al. | |
| 2015/0013994 | A1 | 1/2015 | Bailey et al. | |
| 2015/0096738 | A1 | 4/2015 | Atencio | |
| 2015/0152704 | A1 | 6/2015 | Tunget | |
| 2015/0275649 | A1 | 10/2015 | Orban | |
| 2016/0076327 | A1 | 3/2016 | Glaser et al. | |
| 2016/0084034 | A1 | 3/2016 | Roane et al. | |
| 2016/0130914 | A1 | 5/2016 | Steele | |
| 2016/0160106 | A1 | 6/2016 | Jamison et al. | |
| 2016/0237810 | A1 | 8/2016 | Beaman et al. | |
| 2016/0281458 | A1 | 9/2016 | Greenlee | |
| 2016/0305215 | A1 | 10/2016 | Harris et al. | |
| 2016/0340994 | A1 | 11/2016 | Ferguson et al. | |
| 2017/0044864 | A1 | 2/2017 | Sabins et al. | |
| 2017/0058628 | A1 | 3/2017 | Wijk et al. | |
| 2017/0067313 | A1 | 3/2017 | Connell et al. | |
| 2017/0089166 | A1 | 3/2017 | Sullivan | |
| 2017/0159388 | A1* | 6/2017 | Volgmann | E21B 17/07 |
| 2017/0204703 | A1* | 7/2017 | Mair | E21B 23/14 |
| 2017/0350237 | A1* | 12/2017 | Giem | E21B 47/12 |
| 2018/0010418 | A1 | 1/2018 | VanLue | |
| 2018/0030809 | A1 | 2/2018 | Harestad et al. | |
| 2018/0058167 | A1 | 3/2018 | Finol et al. | |
| 2018/0187498 | A1 | 7/2018 | Soto et al. | |
| 2018/0209565 | A1 | 7/2018 | Lingnau | |
| 2018/0245427 | A1 | 8/2018 | Jimenez et al. | |
| 2018/0252069 | A1 | 9/2018 | Abdollah et al. | |
| 2019/0024473 | A1 | 1/2019 | Arefi | |
| 2019/0049017 | A1 | 2/2019 | McAdam et al. | |
| 2019/0087548 | A1 | 3/2019 | Bennett et al. | |
| 2019/0186232 | A1 | 6/2019 | Ingram | |
| 2019/0203551 | A1 | 7/2019 | Davis et al. | |
| 2019/0284894 | A1 | 9/2019 | Schmidt et al. | |
| 2019/0284898 | A1 | 9/2019 | Fagna et al. | |
| 2019/0301258 | A1 | 10/2019 | Li | |
| 2019/0316424 | A1 | 10/2019 | Robichaux et al. | |
| 2019/0338615 | A1 | 11/2019 | Landry | |
| 2020/0032604 | A1 | 1/2020 | Al-Ramadhan | |
| 2020/0056446 | A1 | 2/2020 | Al-Mousa et al. | |
| 2020/0240225 | A1 | 7/2020 | King et al. | |
| 2021/0025259 | A1 | 1/2021 | Al-Mousa et al. | |
| 2021/0054696 | A1 | 2/2021 | Golinowski et al. | |
| 2021/0054706 | A1 | 2/2021 | Al-Mousa et al. | |
| 2021/0054708 | A1 | 2/2021 | Al-Mousa et al. | |
| 2021/0054710 | A1 | 2/2021 | Neacsu et al. | |
| 2021/0054716 | A1 | 2/2021 | Al-Mousa et al. | |

FOREIGN PATENT DOCUMENTS

| | | |
|---|---|---|
| CA | 1329349 | 5/1994 |
| CA | 2441138 | 3/2004 |
| CA | 2762217 | 5/2015 |
| CA | 2802988 | 10/2015 |
| CA | 2879985 | 4/2016 |
| CA | 2734032 | 6/2016 |
| CN | 203292820 | 11/2013 |
| CN | 103785923 | 6/2016 |
| CN | 104712320 | 12/2016 |
| CN | 107060679 | 8/2017 |
| CN | 107191152 | 9/2017 |
| CN | 107227939 | 10/2017 |
| DK | 2545245 | 4/2017 |
| DK | 2236742 | 8/2017 |
| EP | 0792997 | 1/1999 |
| EP | 2119867 | 11/2009 |
| EP | 2964874 | 1/2016 |
| EP | 2545245 | 4/2017 |
| GB | 958734 | 5/1964 |
| GB | 2021178 | 11/1979 |
| GB | 2392183 | 2/2004 |
| GB | 2396634 | 6/2004 |
| GB | 2414586 | 11/2005 |
| GB | 2425138 | 10/2006 |
| GB | 2453279 | 1/2009 |
| GB | 2492663 | 1/2014 |
| NO | 333538 | 7/2013 |
| NO | 20170293 | 8/2018 |
| OA | 5503 A | 4/1981 |
| WO | WO 1989012728 | 12/1989 |
| WO | WO 1996039570 | 12/1996 |
| WO | WO 2002090711 | 11/2002 |
| WO | WO 2004046497 | 6/2004 |
| WO | WO 2010132807 | 11/2010 |
| WO | WO 2012161854 | 11/2012 |
| WO | WO 2012164023 | 12/2012 |
| WO | WO 2013109248 | 7/2013 |
| WO | WO 2015112022 | 7/2015 |
| WO | WO 2016011085 | 1/2016 |
| WO | WO 2016040310 | 3/2016 |
| WO | WO 2016140807 | 9/2016 |
| WO | WO 2017043977 | 3/2017 |
| WO | WO 2018017104 | 1/2018 |
| WO | WO 2018164680 | 9/2018 |
| WO | WO 2019027830 | 2/2019 |
| WO | WO 2019132877 | 7/2019 |
| WO | WO 2019231679 | 12/2019 |

OTHER PUBLICATIONS

Al-Ibrahim et al., "Automated Cyclostratigraphic Analysis in Carbonate Mudrocks Using Borehole Images," Article #41425, posted presented at the 2014 AAPG Annual Convention and Exhibition, Search and Discovery, Apr. 6-9, 2014, 4 pages.

Bautista et al., "Probability-based Dynamic TimeWarping for Gesture Recognition on RGB-D data," WDIA 2012: Advances in Depth Image Analysis and Application, 126-135, International Workshop on Depth Image Analysis and Applications, 2012, 11 pages.

Boriah et al., "Similarity Measures for Categorical Data: A Comparative Evaluation," presented at the SIAM International Conference on Data Mining, SDM 2008, Apr. 24-26, 2008, 12 pages.

Bruton et al., "Whipstock Options for Sidetracking," Oilfield Review, Spring 2014, 26:1, 10 pages.

Edwards et al., "Assessing Uncertainty in Stratigraphic Correlation: A Stochastic Method Based on Dynamic Time Warping," RM13, Second EAGE Integrated Reservoir Modelling Conference, Nov. 16-19, 2014, 2 pages.

Edwards, "Construction de modéles stratigraphiques ápartir de données éparses," Stratigraphic, Universitéde Lorraine, 2017, 133 pages, English abstract.

Fischer, "The Lofer Cyclothems of the Alpine Triassic," published in Merriam, Symposium on Cyclic Sedimentation: Kansas Geological Survey (KGS), Bulletin, 1964, 169: 107-149, 50 pages.

Forum Energy Technologies "Drill Pipe Float Valves," 2019, Catalog, 6 pages.

Hernandez-Vela et al., "Probability-based Dynamic Time Warping and Bag-of-Visual-and-Depth-Words for human Gesture Recognition in RGB-D," Pattern Recognition Letters, 2014, 50: 112-121, 10 pages.

Herrera and Bann, "Guided seismic-to-well tying based on dynamic time warping," SEG Las Vegas 2012 Annual Meeting, Nov. 2012, 6 pages.

Hydril "Checkguard" Kelly guard Drill Stem Valves, Catalog DSV 2003, Brochure, 9 pages.

Keogh and Ratanamahatana, "Exact indexing of dynamic time warping," Knowledge and Information Systems, Springer-Verlag London Ltd., 2004, 29 pages.

Lallier et al., "3D Stochastic Stratigraphic Well Correlation of Carbonate Ramp Systems," IPTC 14046, International Petroleum Technology Conference (IPTC), presented at the International Petro-

(56) References Cited

OTHER PUBLICATIONS leum Technology Conference, Dec. 7-9, 2009, 5 pages.
Lallier et al., "Management of ambiguities in magneto stratigraphic correlation," Earth and Planetary Science Letters, 2013, 371-372: 26-36, 11 pages.
Lallier et al., "Uncertainty assessment in the stratigraphic well correlation of a carbonate ramp: Method and application of the Beausset Basin, SE France," C. R. Geoscience, 2016, 348: 499-509, 11 pages.
Lineman et al., "Well to Well Log Correlation Using Knowledge-Based Systems and Dynamic Depth Warping," SPWLA Twenty-Eighth Annual Logging Symposium, Jun. 29-Jul. 2, 1987, 25 pages.
Nakanishi and Nakagawa, "Speaker-Independent Word Recognition by Less Cost and Stochastic Dynamic Time Warping Method," ISCA Archive, European Conference on Speech Technology, Sep. 1987, 4 pages.
Packardusa.com [online], "Drop-in Check Valves," Packard International, available on or before Jul. 6, 2007, via Internet Archive: Wayback Machine URL <http://web.archive.org/web/20070706210423/http://packardusa.com/productsandservices5.asp>, retreived on May 11, 2021, URL <www.packardusa.com/productsandservices5.asp>, 2 pages.
Pels et al., "Automated biostratigraphic correlation of palynological records on the basis of shapes of pollen curves and evaluation of next-best solutions," Paleogeography, Paleoclimatology, Paleoecology, 1996, 124: 17-37, 21 pages.
Pollack et al., "Automatic Well Log Correlation," AAPG Annual Convention and Exhibition, Apr. 3, 2017, 1 page, Abstract Only.
Rudman and Lankston, "Stratigraphic Correlation of Well Logs by Computer Techniques," The American Association of Petroleum Geologists, Mar. 1973, 53:3 (557-588), 12 pages.
Sakoe and Chiba, "Dynamic Programming Algorithm Optimization for Spoken Word Recognition," IEEE Transactions on Acoustics, Speech and Signal Processing, ASSP-26:!, Feb. 1978, 7 pages.
Salvador and Chan, "FastDTW: Toward Accurate Dynamic Time Warping in Linear Time and Space," presented at the KDD Workshop on Mining Temporal and Sequential Data, Intelligent Data Analysis, Jan. 2004, 11:5 (70-80), 11 pages.
Sayhi, "peakdet: Peak detection using MATLAB," Jul. 2012, 4 pages.
Scribd.com [online], "Milling Practices and Procedures," retrieved from URL <https://www.scribd.com/document/358420338/Milling-Rev-2-Secured>, 80 pages.
Silva and Koegh, "Prefix and Suffix Invariant Dynamic Time Warping," IEEE Computer Society, presented at the IEEE 16th International Conference on Data Mining, 2016, 6 pages.
Smith and Waterman, "New Stratigraphic Correlation Techniques," Journal of Geology, 1980, 88: 451-457, 8 pages.
Startzman and Kuo, "A Rule-Based System for Well Log Correlation," SPE Formative Evaluation, Society of Petroleum Engineers (SPE), Sep. 1987, 9 pages.
TAM International Inflatable and Swellable Packers, "TAM Scab Liner brochure," Tam International, available on or before Nov. 15, 2016, 4 pages.
Tomasi et al., "Correlation optimized warping and dynamic time warping as preprocessing methods for chromatographic data," Journal of Chemometrics, 2004, 18: 231-241, 11 pages.
Uchida et al., "Non-Markovian Dynamic Time Warping," presented at the 21st International Conference on Pattern Recognition (ICPR), Nov. 11-15, 2012, 4 pages.
Waterman and Raymond, "The Match Game: New Stratigraphic Correlation Algorithms," Mathematical Geology, 1987, 19:2, 19 pages.
Weatherford, "Micro-Seal Isolation System-Bow (MSIS-B)," Weatherford Swellable Well Construction Products, Brochure, 2009-2011, 2 pages.
Zoraster et al., "Curve Alignment for Well-to-Well Log Correlation," SPE 90471, Society of Petroleum Engineers (SPE), presented at the SPE Annual Technical Conference and Exhibition, Sep. 26-29, 2004, 6 pages.

* cited by examiner

CABLE HEAD FOR A WIRELINE TOOL

TECHNICAL FIELD

This disclosure relates to a cable head for a wireline tool, a wireline tool, and a method of retrieving a lost wireline tool.

BACKGROUND

During the lifetime of a drilling well, workover and intervention activities are sometimes necessary. Workover refers to maintenance or remedial work on a well that restores, prolongs, or enhances hydrocarbon production. Wireline tools are often used for workover activities. For example, wireline tools are used to evaluate the properties of a reservoir, locate equipment within a wellbore, determine formation pressure and pore size, identify liquids found in the reservoir, and capture fluid samples in the reservoir for evaluation at a topside facility. Generally, a wireline tool is connected to the end of a wireline and lowered into the wellbore. A cable head is a device that mechanically, and in some cases also electrically, connects the wireline tool to the wireline.

SUMMARY

In an example implementation, a cable head for a wireline tool includes a housing that includes an outlet opening for a wireline and an interface configured to connect the housing to the wireline tool, a spool rotatably mounted in the housing, an anchoring point configured for mechanical attachment to an end of the wireline, and a drive configured to rotate the spool and thereby wrap a portion of the wireline around the spool to and retract the wireline into the housing.

In an aspect combinable with the example implementation, the interface includes a fastener for fastening the housing to the wireline tool.

In another aspect combinable with the example implementation, the drive includes a motor configured to rotate the spool to wrap a portion of the wireline around the spool, and a control unit configured to control the motor.

In another aspect combinable with the example implementation, the interface includes an electrical connection configured to connect to an external power supply.

In another aspect combinable with the example implementation, the cable head includes a battery connected to the motor.

In another aspect combinable with the example implementation, the cable head includes a sensor configured detect an electrical connection to aboveground equipment through the wireline, wherein the control unit is configured to control the motor based on the detected electrical connection.

In another aspect combinable with the example implementation, the cable head includes an accelerometer configured to detect an acceleration of the cable head, wherein the control unit is configured to control the motor based on the detected acceleration. For example, the control unit can be configured to determine the location of the cable head within a wellbore based on the detected acceleration.

In another aspect combinable with the example implementation, the cable head includes a wireless transmitter configured to wirelessly transmit the location of the cable head in response to a signal from the control unit.

In another aspect combinable with the example implementation, the cable head includes a tension sensor configured to detect the tension of the wireline, wherein the control unit is configured to control the motor based on the tension detected by the tension sensor.

In a further example implementation, a wireline tool includes a housing that includes an outlet opening for a wireline, one or more sensors arranged in the housing and configured to detect one or more physical properties of a wellbore, a spool rotatably mounted in the housing, an anchoring point inside the housing that is configured for mechanical attachment to an end of the wireline, and a drive configured to rotate the spool and thereby wrap a portion of the wireline around the spool to and retract the wireline into the housing.

In an aspect combinable with the example implementation, the drive includes a motor configured to rotate the spool to wrap a portion of the wireline around the spool, a power supply connected to the motor and the one or more sensors arranged in the housing, and a control unit configured to control the motor.

In a further aspect combinable with the example implementation, the wireline tool includes a sensor configured detect an electrical connection to aboveground equipment through the wireline, wherein the control unit is configured to control the motor based on the detected electrical connection.

In a further aspect combinable with the example implementation, the wireline tool includes an accelerometer configured to detect an acceleration of the cable head, wherein the control unit is configured to control the motor based on the detected acceleration. For example, the control unit can be configured to determine the location of the cable head within a wellbore based on the detected acceleration.

In a further aspect combinable with the example implementation, the wireline tool includes a wireless transmitter configured to wirelessly transmit the location of the cable head in response to a signal from the control unit.

In a further aspect combinable with the example implementation, the wireline tool includes a tension sensor configured to detect the tension of the wireline, wherein the control unit is configured to control the motor based on the tension detected by the tension sensor.

In yet a further example implementation, a method of retrieving a lost wireline tool includes connecting a first wireline to an anchoring point of a wireline tool, lowering, by the first wireline, the wireline tool into a wellbore, determining that the first wireline has been severed, and in response to determining that the first wireline has been severed, wrapping a portion of the severed first wireline around a spool of the wireline tool.

In an aspect combinable with the example implementation, wrapping a portion of the severed first wireline around a spool of the wireline tool includes rotating the spool using a motor.

In a further aspect combinable with the example implementation, determining that the first wireline has been severed includes detecting an interruption in an electrical connection to aboveground equipment through the first wireline.

In a further aspect combinable with the example implementation, determining that the first wireline has been severed includes detecting a downward acceleration of the wireline tool down the wellbore.

In a further aspect combinable with the example implementation, determining that the first wireline has been severed includes detecting a decrease in tension on the first wireline.

In a further aspect combinable with the example implementation, the method includes transmitting a location of the wireline tool within the wellbore to an aboveground receiver.

In a further aspect combinable with the example implementation, the method includes lowering, by a second wireline, a fishing tool into the wellbore, grasping the wireline tool with the fishing tool, and raising, by the second wireline, the fishing tool and the wireline tool from the wellbore.

The details of one or more implementations of the subject matter described in this disclosure are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

Figure 1A:
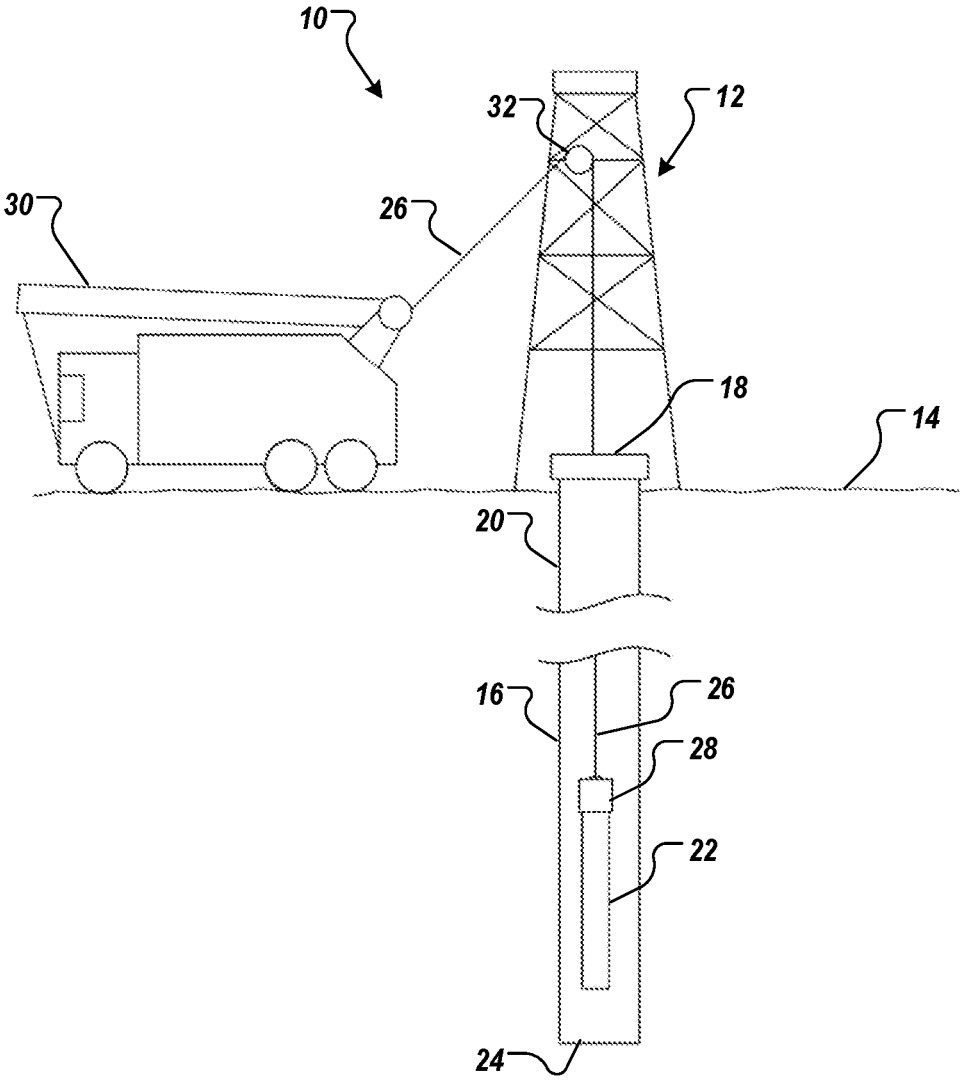
FIG. 1A is a schematic diagram of an example wellbore system with a wireline tool that includes a cable head according to the present disclosure.

FIG. 1A is a schematic diagram of an example wellbore system 10 with a wireline tool that includes a cable head according to the present disclosure. Generally, FIG. 1A illustrates a portion of one embodiment of a wellbore system 10 in which a wireline tool is connected to a wireline by the cable head. The cable head, as described more fully in the present disclosure, includes a housing that includes an outlet opening for a wireline and an interface configured to connect the housing to the wireline tool; a spool rotatably mounted in the housing; and an anchoring point configured for mechanical attachment to an end of the wireline. The spool is configured to rotate and wrap a portion of the wireline around the spool to retract the wireline into the housing. Other aspects of the disclosure include a wireline tool and a method of retrieving a lost wireline tool.

The wellbore system 10 is designed to access a subterranean formation and provide access to hydrocarbons located in the subterranean formation. As illustrated in FIG. 1A, the wellbore system 10 includes a drilling assembly 12 deployed on a terranean surface 14. The drilling assembly 12 may be used to form a wellbore 16 extending from the terranean surface 14 and through one or more geological formations in the Earth.

The drilling assembly 12 may be any appropriate assembly or drilling rig used to form wellbores or boreholes in the Earth. The drilling assembly 12 may use traditional techniques to form such wellbores, such as the wellbore 16, or may use nontraditional or novel techniques. In some embodiments, the drilling assembly 12 may use rotary drilling equipment to form such wellbores. Rotary drilling equipment generally includes a drill string and the downhole tool (not shown). Rotating drilling equipment on such a rotary drilling rig may include components that serve to rotate a drill bit, which in turn forms a wellbore, such as the wellbore 16, deeper and deeper into the ground. The illustrated drilling assembly 12 includes a blowout preventer 18 positioned at the surface of the wellbore 16. The blowout preventer 18 can close around (and in some instances, pass through) the drill string to seal off the space between the drill string and the wellbore wall. The illustrated wellbore system is only one example. Other wellbore systems 10 can include a circulation system for drilling fluid or a topside facility, for example.

In some embodiments, the wellbore 16 may be cased with one or more casings. As illustrated, the wellbore 16 includes a conductor casing 20 that extends from the terranean surface 14 a short distance into the Earth. In some cases, a portion of the wellbore 16 enclosed by the conductor casing 20 may be a large diameter borehole. In some cases, the wellbore 16 may include additional casings (not shown) downhole from the conductor casing 20. For example, an additional surface casing may enclose a slightly smaller borehole and protect the wellbore 16 from intrusion of, for example, freshwater aquifers located near the terranean surface 14.

During the lifetime of the wellbore system 10, workover and intervention activities are sometimes necessary. Workover refers to maintenance or remedial work on to restore, prolong, or enhance hydrocarbon production. Wireline tools are often used for such workover activities. For example, wireline tools are used to evaluate the reservoir, locate equipment within a wellbore, determine formation pressure and pore size, identify liquids found in the reservoir, and capture fluid and other samples in the reservoir for evaluation at a topside facility.

FIG. 1A depicts a wireline tool 22 is shown near a bottom 24 of the wellbore 16. The wireline tool 22 is connected to the end of a wireline 26 and lowered into the wellbore 16. In some implementations, the wireline 26 includes a single-strand wire or cable. In other cases, the wireline 26 may include braided wire or cable. In some cases, the wireline can include electrical conductors that are used to transmit data between the tool 22 and surface equipment. In some contexts, a wire or cable that incorporates electrical conductors is referred to as a "wireline" and a thin cable without electrical conductors is referred to as a "slickline." However, the present disclosure applies the term "wireline" to both types of cables.

As shown, the wireline 26 is connected at one end to the wireline tool 22 by a cable head 28. The opposite end of the wireline 26 is connected to a vehicle, such as a truck 30. The end of the wireline 26 is wrapped around a drum that is mounted to the truck 30 (not shown). The wireline 26 and the tool 22 are raised and lowered by reeling the wire wrapped around the drum in and out. In the illustrated implementation, the drilling assembly 12 includes a pulley 32 that supports the wireline 26.

Although the wireline 26 is made of robust materials, there are times when the wireline 26 may sever. The wireline 26 may sever due to mechanical failure, e.g., when the tool 22 becomes stuck in the wellbore 16 and the truck 30 attempts to reel in the wireline 26. The material of the wireline 26 may also be compromised by the substances found at the bottom 24 of the wellbore 16. When the wireline 26 severs, a first part of the wireline 26 remains attached to the truck 30 and the pulley 32. A second part of the severed wireline 26 remains connected to the tool 22 via the cable head 28. Since the severed wireline 26 can no longer support the tool 22, the tool 22 may fall to the bottom 24 of the wellbore 16, as shown in FIG. 1B, or remain stuck at an intermediate location in the wellbore 16.

Figure 2:
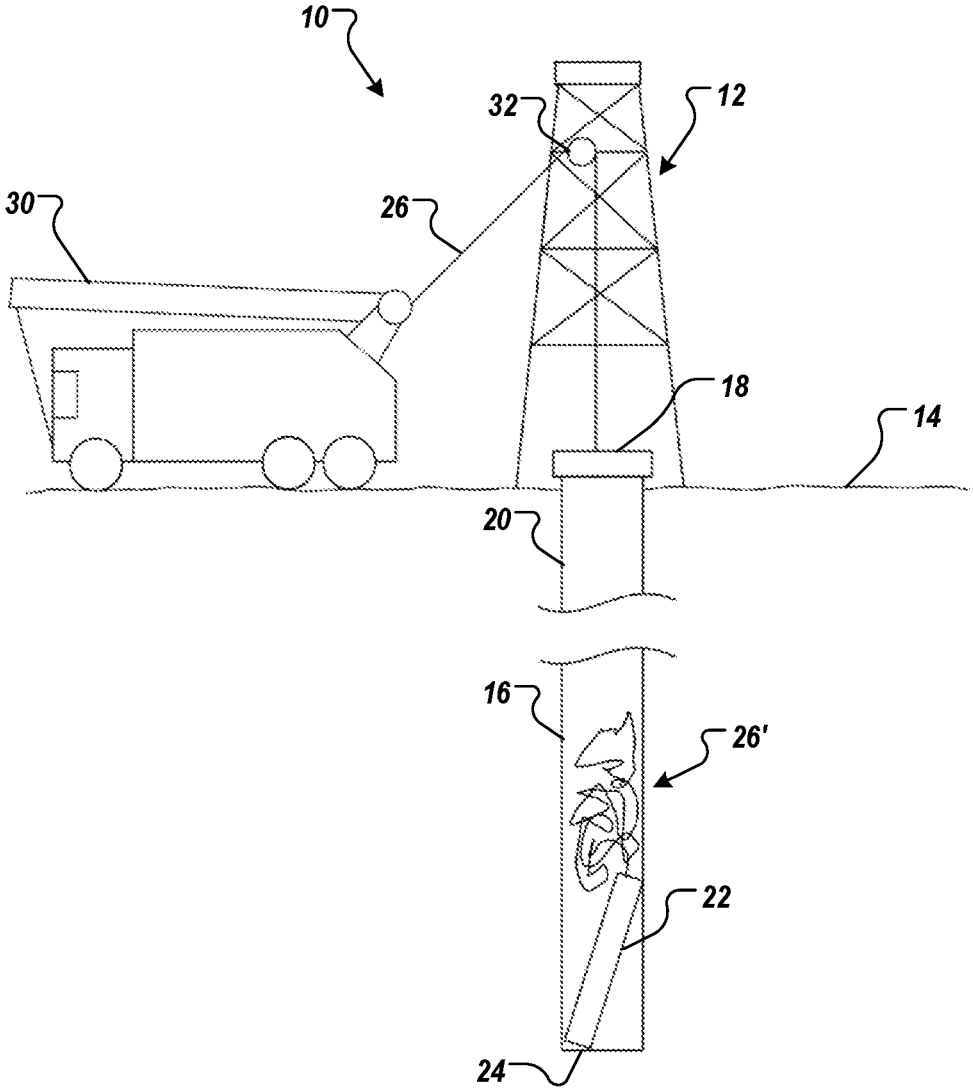
FIG. 2 is a schematic diagram of a wireline tool connected to a tangled and severed wireline.

In implementations of the present disclosure, the cable head 28 is configured to retract the second part of the severed wireline 26 into a body of the cable head 28. In contrast, FIG. 2 depicts a wellbore system 10 that does not include such a cable head 28. In such cases, the second part 26' of the severed wireline 26 is prone to tangle or form a bird's nest. The size of the bird's nest correlates with the length of the second part 26' of the severed wireline 26. In general, the bird's nest makes it difficult to grasp the lost tool 22 for retrieval from the wellbore 16. For example, multiple tools and operations may be required to gain access to the tool 22 at the bottom 24 of the wellbore 16.

Figure 1B:
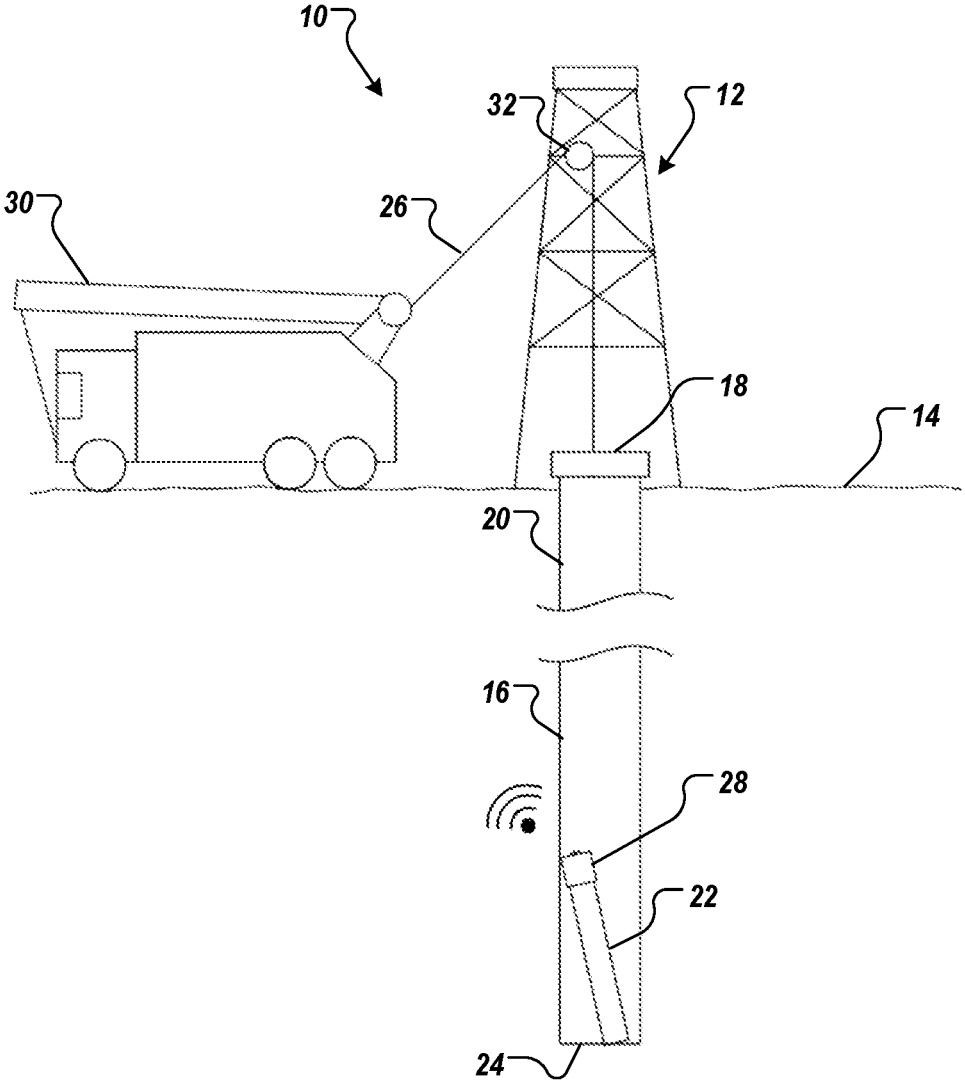
FIG. 1B is a schematic diagram of the wellbore system in FIG. 1A when the wireline is severed from the cable head.

In FIG. 1B, the second part 26' of the wireline 26 is fully retracted into the body of the cable head 28, making it easier for retrieval tools to grasp the cable head 28 and wireline tool 22. Depending on the length of the second part 26' of the severed wireline, a small portion of the wireline 26 may still protrude from the cable head 28 in some implementations. Even in such cases, the cable head 28 of the present disclosure minimizes the obstructions caused by the severed wireline 26 and improves the retrieval process for lost wireline tools.

In some implementations, the cable head 28 may be configured to transmit a wireless signal that indicates the location of the wireline tool 22, as depicted in FIG. 1B. For example, the wellbore 16 may not necessarily extend in a straight vertical direction, as shown in FIG. 1B. Some wellbores may be offset from the vertical (for example, a slant wellbore). Other wellbores may be a stepped wellbore, such that a portion is drilled vertically downward and then curved to a substantially horizontal wellbore portion. Depending on the depth and location of the target subterranean formations, other wellbores may include multiple vertical and horizontal wellbore portions. In all of these cases, the wireless signal emitted by the cable head 28 may help to locate and recover the lost wireline tool 22.

Figure 3:
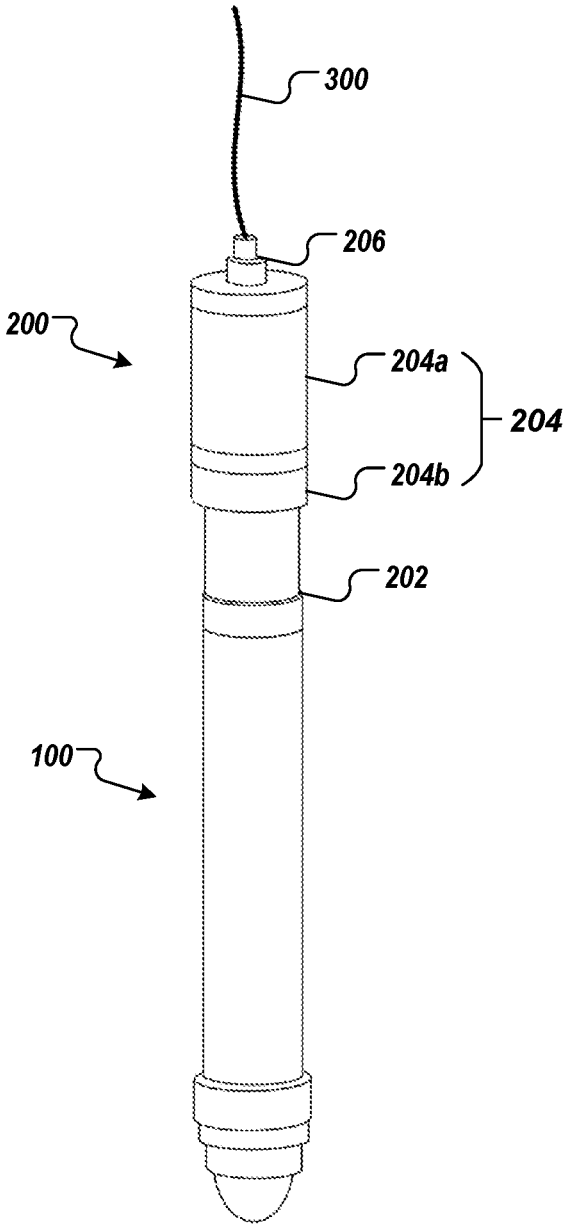
FIG. 3 is a schematic diagram of an example implementation of a wireline tool that includes a cable head according to the present disclosure.

FIG. 3 is a schematic diagram of an example implementation of a wireline tool 100 that includes a cable head 200 according to the present disclosure. In some aspects, the wireline tool 100 and the cable head 200 may be part of wireline tool 22 and the cable head 28 shown in FIGS. 1A and 1B. In the illustrated example, the wire line tool 100 is depicted as a logging tool. A logging tool can be used to obtain a record of the rock properties of a subterranean formation. The logging tool includes one or more instruments and sensors that detect and record the physical properties of the formation as the tool 100 moves along the length of the wellbore (not shown). In some implementations, the tool 100 is used for other purposes, such as, locating equipment within the wellbore or capturing samples from the reservoir for analysis.

The illustrated cable head 200 includes an interface 202 that connects to the tool 100. The interface 202 can be implemented in a variety of ways. For example, the interface 202 may include a fastener that creates a non-permanent joint between the cable head 200 and the tool 100. Examples of fasteners are one or more threaded fasteners, bolts, clamps, flanges, or pins. In other examples, the interface 202 may form a bonded or welded connection between the cable head 200 and the tool 100. In other examples, the cable head 200 and the tool 100 may be integrally formed and contained, for example, in a common housing. The type of interface 202 may be tailored to maintenance and form factor considerations. For example, a releasable interface 202 may be used with a variety of tools and may be restored to its initial state after a retrieval operation. In contrast, a common housing may reduce the overall package size of the cable head and tool assembly and make it easier to navigate complex wellbore geometries.

In some implementations, the cable head 200 includes a housing 204 that includes an upper housing part 204*a*, a lower housing part 204*b*, and a guide 206. The upper housing part 204*a* contains a spool (FIG. 4A-4C) for winding a severed portion of the wireline 300. The lower housing part 204*b* contains a drive that rotates the spool when the wireline 300 is severed. The guide 206 is provided at a top surface of the housing 204 and provides an outlet for the wireline 300 to extend from the housing 204 and an inlet for wireline 300 to be retracted into housing 204, if needed.

In one example implementation, the spool in the upper housing part 204*a* may be connected to a coiled spring contained in the lower housing part 204*b*. During logging operations, the weight of the tool 100 and the cable head 200 may cause the coiled spring to uncoil as the tool 100 is suspended in the wellbore. If the wireline 300 is severed, the force of the coiled spring turns the spool and winds the severed portion of the wireline 300 around the spool. As described in more detail in reference to FIG. 4A to 4C, the spool can also be driven by a motor. In both examples, the cable head 200 is designed to retract part of the severed wireline 300 into the housing 204 of the cable head 200.

Figure 4C:
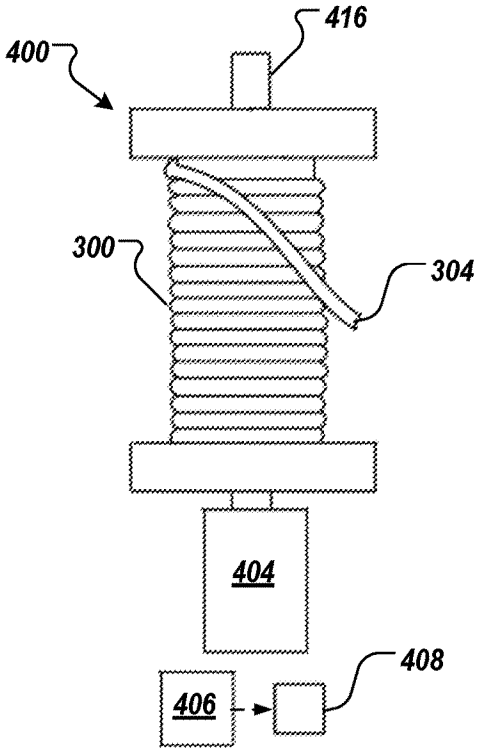
FIG. 4A to 4C are schematic diagrams of the components of an example implementation of a cable head according to the present disclosure.
Figure 4B:
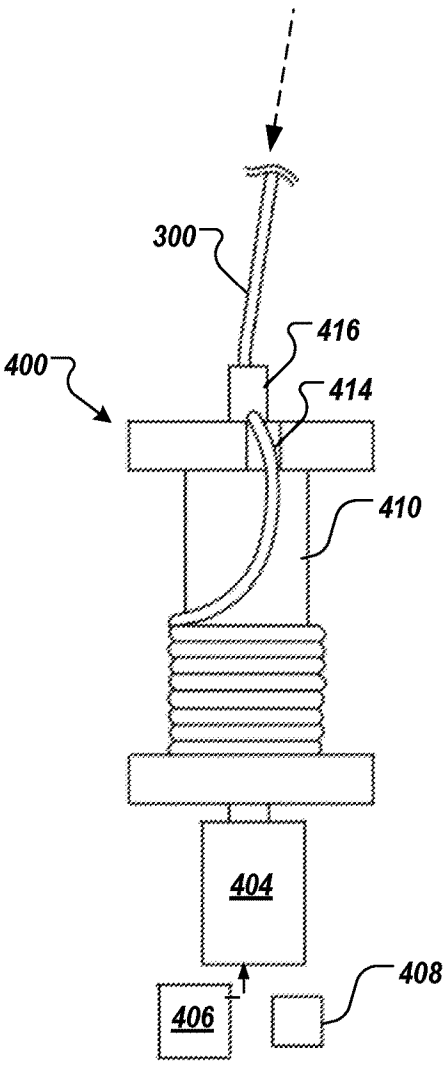
Figure 4A:
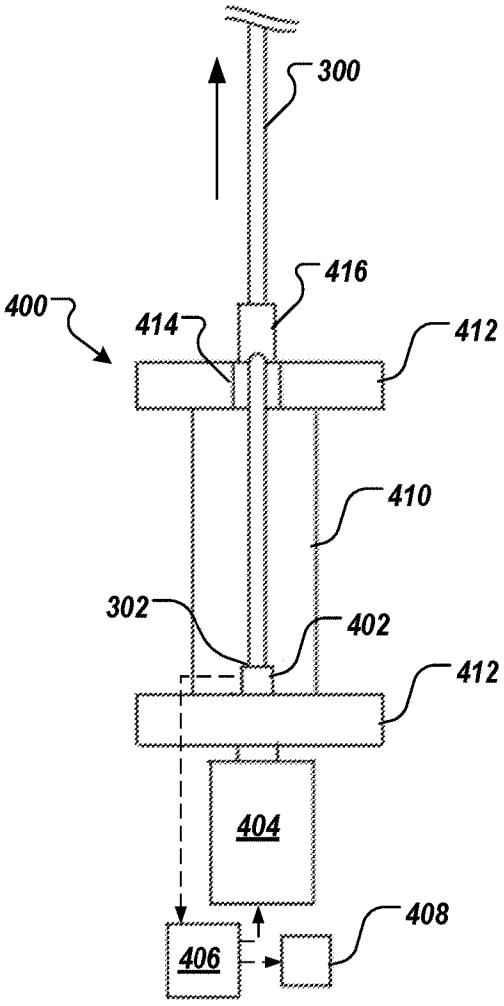

FIG. 4A to 4C are schematic diagrams of the components of an example implementation of a cable head according to the present disclosure. In some aspects, the components depicted in FIG. 4A to 4C may be part of the cable head 200 shown in FIG. 3. More specifically, FIG. 4A is a schematic diagram of the inner components of the cable head when the wireline 300 is not severed. For example, the wireline 300 may be connected to a truck parked at the surface of the wellbore system, as shown in FIGS. 1A and 1B. In FIG. 4A, the weight of the wireline tool and the cable head apply tension to the wireline 300, as indicated by the direction of the solid upward arrow. FIG. 4B is a schematic diagram of the inner components of the cable head after the wireline 300 has been severed. In comparison to FIG. 4A, the wireline 300 is slack. Further, the cable head has begun reeling in the wireline 300, as schematically represented by the dashed arrow. FIG. 4C is a schematic diagram of the inner components of the wireline 300 after the wireline has been completely retracted.

As shown in FIG. 4A, the components of the cable head include a spool 400, a wireline sensor 402, a motor 404, a control unit 406, and a wireless transmitter 408. The components 400-408 are contained in a housing of the cable head (not shown). For example, the spool 400 and the wireline sensor 402 can be contained in the upper housing part 204*a* shown in FIG. 3, whereas the motor 404, the control unit 406, and the wireless transmitter 408 can be contained in the housing 204*b*.

The spool 400 is configured to reel in and store the severed wireline 300. The spool 400 includes a core 410 and two end plates 412 and is supported in the housing (not shown) of the cable head so that the spool 400 can rotate relative to the rest of the cable head components. For example, the core 410 may have a bore for mounting the core 410 on a shaft (not shown). As shown in FIG. 4C, the outer diameter and length of the core 410 are selected so that a suitable length of severed wireline 300 can be wrapped around the core 410. As shown in FIG. 4A, an upper end plate 412 includes a feed notch or groove 414 that guides the wireline 300 as the wireline 300 is wrapped onto the core 410. In some implementations, the housing of the cable head may include a loop or eyelet to guide the wireline 300 as the wireline 300 is wrapped onto the core 410.

One end 302 of the wireline 300 is anchored to the spool 400 at an anchoring point. The wireline 300 extends from this anchoring point along the axial length of the core 410 of the spool 400. The wireline 300 further extends through the feed notch 414 in the end plate 412 of the spool 400 and through a guide 416 arranged on the end plate 412. The guide 416 may correspond to the guide 206 depicted in FIG. 3. Although FIG. 4A schematically depicts the anchoring point near the core 410 of the spool 400, the anchoring point for the end 302 of the wireline 300 may be provided on a different part of the cable head, e.g., the shaft on which the spool 400 is mounted.

The wireline sensor 402 is configured to detect that the wireline 300 has been severed. In implementations of the present disclosure, a severed wireline 300 can be detected based on an electrical connection through the wireline 300 to aboveground equipment, on the movement of the wireline tool, and on tension applied to the wireline 300. In some implementations, the wireline sensor 402 can detect a severed wireline 300 based on a combination of two or more of these factors.

As described above, the wireline 300 can establish both a mechanical and an electrical connection to aboveground equipment. In this case, the wireline sensor 402 can be configured to detect the electrical connection to aboveground equipment via the wireline 300. When the wireline 300 is severed, the electrical connection is also severed. The wireline sensor 402 can output a signal that represents this electrical connection to the control unit 406, for example. When the signal is interrupted over a period of time, the control unit 406 can be configured to determine that the wireline 300 has been severed.

In some implementations, the wireline sensor 402 includes an accelerometer that detects the movement of the cable head and wireline tool along the wellbore. When the wireline 300 is severed, the accelerometer can detect that the cable head and wireline tool have begun to fall. Similarly, the accelerometer can detect when the cable head and wireline tool come to rest, for example, at the bottom of the wellbore. The control unit 406 can be configured to receive output from the accelerometer to detect the duration and speed of the fall and estimate the approximate position of the wireline tool.

In some implementations, the wireline sensor 402 is configured to sense whether tension is applied to the wireline 300. For example, in normal operations of the wireline tool, the wirelines is connected to an aboveground structure and the weight of the tool places the wireline 300 under tension that is detected by the wireline sensor 402. In this case, the wireline sensor 402 may be located adjacent to the anchoring point of the wireline 300, as shown in FIG. 4A. In some implementations, the wireline sensor 402 is configured to send the detected tension values to the control unit 406. Based on the tension values output by the wireline sensor 402, the control unit 406 is configured to detect whether the wireline 300 has been severed. In some cases, the wireline sensor 402 is configured to detect the tension of the wireline 300 over a period of time, and the control unit 406 is configured to determine that the wireline 300 has been severed based on the detected tension. Accordingly, the control unit 406 may distinguish a continuous drop in tension from a temporary change in tension. For example, a stable drop in tension may indicate that the wireline has been severed, while a temporary change in tension may indicate a snag or jog in a wireline that remains connected to aboveground structures.

In some implementations, the control unit 406 is configured to control the motor 404 based on input from the wireline sensor 402. For example, the control unit 406 is configured to determine that the wireline 300 has been severed and control the motor 404 in response to this. The motor 404 is configured to rotate the spool 400 about its support shaft for a predetermined time period that allows an appropriate length of severed wireline to be reeled in. Alternatively, the motor 404 can rotate the spool 400 until an onboard battery (not shown) is empty. As shown in FIG. 4B, rotation of the spool 400 causes the wireline 300 to wrap around the core 410, thus retracting the severed portion of the wireline 300 into the housing of the cable head. In the illustrated implementation, the motor 404 and the spool 400 are arranged coaxially along an axis of the wireline tool and the wellbore. However, in other implementations, the spool 400 may have different dimensions and be arranged to rotate about an axis that is perpendicular to the axis of the wireline tool and the wellbore.

In some implementations, the control unit 406 includes a power supply and memory, for example, for recording the tension values detected by the wireline sensor 402. In some cases, the power supply and the memory can be common to both the cable head and the wireline tool. For example, the interface 202 shown in FIG. 3 may include an electrical connection that connects the cable head to an external power supply. For example, the electrical connection provided by the interface 202 may connect the control unit 406 to the wireline tool's power supply to power the motor. In other implementations, the cable head may include a battery to power the components of the cable head. In some implementations, the electrical connection may additionally connect the control unit 406 to a memory of the wireline tool.

In some implementations, the severed part of the wireline 300 is completely wrapped around the core 410 of the spool 400, as shown in FIG. 4C. As illustrated, the rotation of the core spool 400 may pull a severed end 304 of the wireline 300 through the guide 416 so that the wireline 300 is completely retracted into the cable head housing. In other cases, the severed end 304 of the wireline 300 may remain outside of the cable head housing. Once the severed wireline 300 has been retracted, the control unit 406 may instruct a wireless transmitter 408 to transmit data to an aboveground structure. In some implementations, the wireless transmitter 408 is configured to wirelessly transmit the location of the cable head within a wellbore in response to a signal from the control unit 406. For example, the wireless transmitter 408 may transmit data indicating the depth of the tool within the wellbore and length of the severed portion of the wireline 300.

Figure 5:
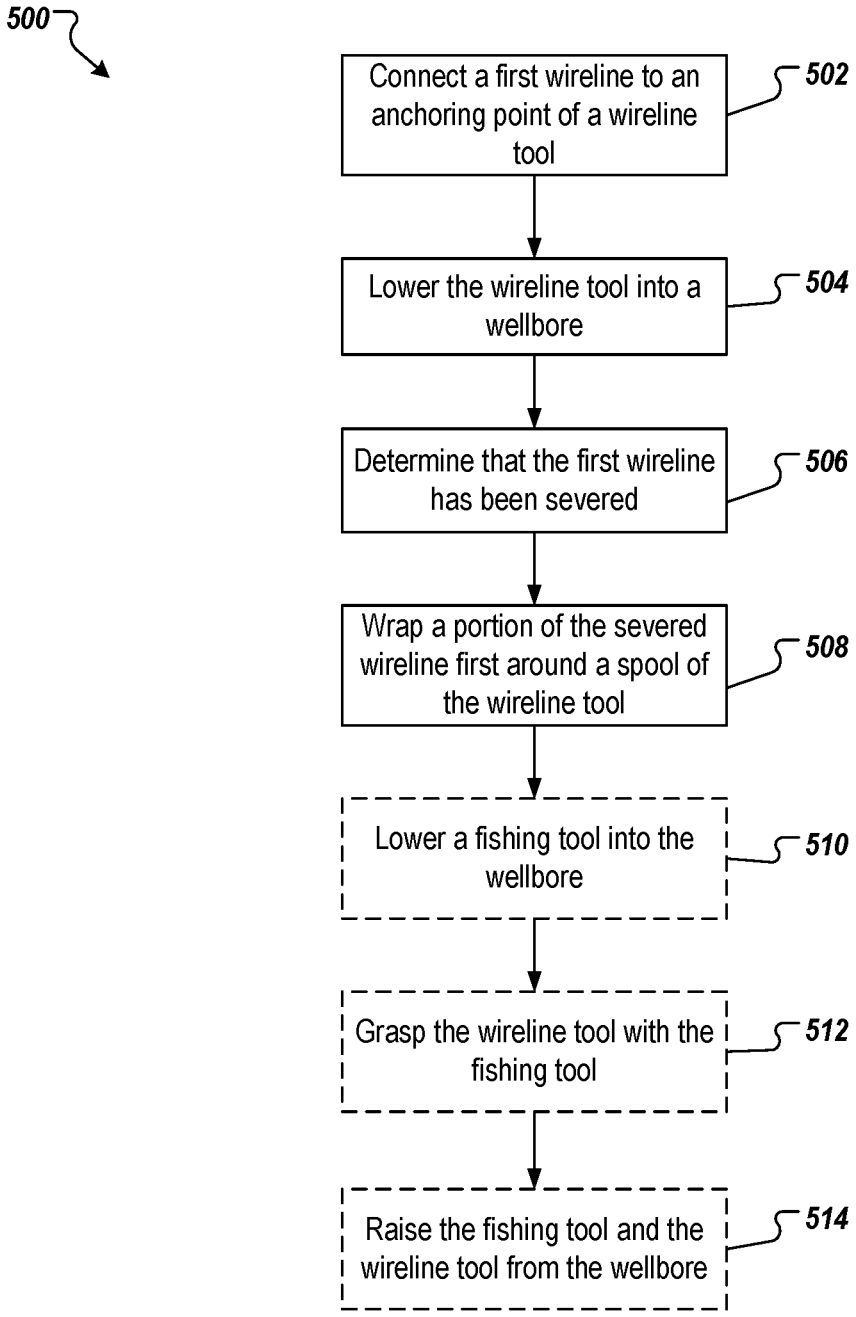
FIG. 5 depicts an example method of retrieving a lost wireline tool in accordance with implementations of the present disclosure.

FIG. 5 depicts an example method 500 of retrieving a lost wireline tool. Implementations of the method 500 can use the wireline tool and cable head depicted in FIG. 1A to 4C.

The method 500 includes connecting 502 a first wireline to an anchoring point of a wireline tool. In some cases, the anchoring point is provided in a cable head that connects to the wireline tool. In other cases, the wireline tool itself provides the anchoring point for the wireline. The method 500 also includes lowering 504, by the first wireline, the wireline tool into a wellbore. As shown above in reference to FIGS. 1A and 1B, a wireline truck may be used to lower the wireline tool into the wellbore. The method 500 also includes determining 506 that the first wireline has been severed. For example, the wireline tool or the cable head may use any of the previously described techniques to determine that the first wireline has been severed. For example, the determining that the first wireline has been severed can include detecting an interruption in an electrical connection to aboveground equipment through the first wireline. Determining that the first wireline has been severed can include detecting a downward acceleration of the wireline tool down the wellbore. Determining that the first wireline has been severed can also include a decrease in tension on the first wireline. In some implementations, determining that the first wireline has been severed can include a combination of two or more of the described techniques. The method 500 also includes wrapping 508 a portion of the severed first wireline around a spool of the wireline tool in response to determining that the first wireline has been severed. For example, wrapping a portion of the severed first wireline around a spool of the wireline tool can include rotating the spool using a motor. In some implementations, the spool is part of the cable head. In other cases, the spool is part of the wireline tool itself.

In some implementations, the method further includes transmitting a location of the wireline tool within the wellbore to an aboveground receiver.

In some implementations, the method 500 includes lowering 510, by a second wireline, a fishing tool into the wellbore; grasping 512 the wireline tool with the fishing tool; and raising 514, by the second wireline, the fishing tool and the wireline tool from the wellbore. Since the method 500 includes retracting a portion of the severed to first wireline by wrapping the severed first wireline around a spool of the wireline tool, the fishing tool is able to more easily engage the wireline tool for retrieval. Thus, the described implementations provide a simple and effective method for retrieving a lost wireline tool.

A number of implementations have been described. Nevertheless, it will be understood that various modifications may be made without departing from the spirit and scope of the disclosure. For example, example operations, methods, or processes described herein may include more steps or fewer steps than those described. Further, the steps in such example operations, methods, or processes may be performed in different successions than that described or illustrated in the figures.

In some embodiments, the wellbore system may be deployed on a body of water rather than the terranean surface, as depicted in the figures. For instance, in some embodiments, the terranean surface may be an ocean, gulf, sea, or any other body of water under which hydrocarbon-bearing formations may be found. In short, reference to the terranean surface includes both land and water surfaces and contemplates forming and developing one or more wellbore systems from either or both locations.

Although the wellbore depicted in the figures extends in a vertical direction, in some embodiments, the wellbore may be offset from the vertical (for example, a slant wellbore). Even further, in some embodiments, the wellbore may be a stepped wellbore, such that a portion is drilled vertically downward and then curved to a substantially horizontal wellbore portion. Additional substantially vertical and horizontal wellbore portions may be added according to, for example, the type of terranean surface, the depth of one or more target subterranean formations, the depth of one or more productive subterranean formations, or other criteria.

Accordingly, other implementations are within the scope of the following claims.

What is claimed is:

1. A cable head for a wireline tool, the cable head comprising:

a housing that comprises an outlet opening for a wireline and an interface configured to connect the housing to the wireline tool;

a spool rotatably mounted in the housing;

an anchoring point configured for mechanical attachment to an end of the wireline; and a drive configured to rotate the spool and thereby wrap a portion of the wireline around the spool to and retract the wireline into the housing.

2. The cable head of claim 1, wherein the interface comprises a fastener for fastening the housing to the wireline tool.

3. The cable head of claim 1, wherein the drive comprises:

a motor configured to rotate the spool to wrap a portion of the wireline around the spool; and a control unit configured to control the motor.

4. The cable head of claim 3, wherein the interface comprises an electrical connection configured to connect to an external power supply.

5. The cable head of claim 3, further comprising a battery connected to the motor.

6. The cable head of claim 3, further comprising a sensor configured to detect an electrical connection to above ground equipment through the wireline, wherein the control unit is configured to control the motor based on the detected electrical connection.

7. The cable head of claim 3, further comprising an accelerometer configured to detect an acceleration of the cable head, wherein the control unit is configured to control the motor based on the detected acceleration.

8. The cable head of claim 7, wherein the control unit is configured to determine the location of the cable head within a wellbore based on the detected acceleration.

9. The cable head of claim 8, further comprising a wireless transmitter configured to wirelessly transmit the location of the cable head in response to a signal from the control unit.

10. The cable head of claim 3, further comprising a tension sensor configured to detect the tension of the wireline, wherein the control unit is configured to control the motor based on the tension detected by the tension sensor.

11. A wireline tool comprising:

a housing that comprises an outlet opening for a wireline;

one or more sensors arranged in the housing and configured to detect one or more physical properties of a wellbore;

a spool rotatably mounted in the housing;

an anchoring point inside the housing that is configured for mechanical attachment to an end of the wireline; and a drive configured to rotate the spool and thereby wrap a portion of the wireline around the spool to and retract the wireline into the housing.

12. The wireline tool of claim 11, wherein the drive comprises:

a motor configured to rotate the spool to wrap a portion of the wireline around the spool;

a power supply connected to the motor and the one or more sensors arranged in the housing; and a control unit configured to control the motor.

13. The wireline tool of claim 12, further comprising a sensor configured to detect an electrical connection to above ground equipment through the wireline, wherein the control unit is configured to control the motor based on the detected electrical connection.

14. The wireline tool of claim 12, further comprising an accelerometer configured to detect an acceleration of the cable head, wherein the control unit is configured to control the motor based on the detected acceleration.

15. The wireline tool of claim 14, wherein the control unit is configured to determine the location of the cable head within a wellbore based on the detected acceleration.

16. The wireline tool of claim 15, further comprising a wireless transmitter configured to wirelessly transmit the location of the cable head in response to a signal from the control unit.

17. The wireline tool of claim 12, further comprising a tension sensor configured to detect the tension of the wireline, wherein the control unit is configured to control the motor based on the tension detected by the tension sensor.

18. A method of retrieving a lost wireline tool, the method comprising:

connecting a first wireline to an anchoring point of a wireline tool;

lowering, by the first wireline, the wireline tool into a wellbore;

determining that the first wireline has been severed; and in response to determining that the first wireline has been severed, wrapping a portion of the severed first wireline around a spool of a cable head of the wireline tool.

19. The method of claim 18, wherein wrapping a portion of the severed first wireline around a spool of the wireline tool comprises rotating the spool using a motor.

20. The method of claim 18, wherein determining that the first wireline has been severed comprises detecting an interruption in an electrical connection to aboveground equipment through the first wireline.

21. The method of claim 18, wherein determining that the first wireline has been severed comprises detecting a downward acceleration of the wireline tool down the wellbore.

22. The method of claim 18, wherein determining that the first wireline has been severed comprises detecting a decrease in tension on the first wireline.

23. The method of claim 18, further comprising transmitting a location of the wireline tool within the wellbore to an aboveground receiver.

24. The method of claim 18, further comprising:

lowering, by a second wireline, a fishing tool into the wellbore;

grasping the wireline tool with the fishing tool; and raising, by the second wireline, the fishing tool and the wireline tool from the wellbore.

* * * * *